US009614325B2

(12) United States Patent
Yuan et al.

(10) Patent No.: US 9,614,325 B2
(45) Date of Patent: Apr. 4, 2017

(54) BLIND-MATE INTEGRATED CONNECTOR

(71) Applicant: Huawei Technologies Co., Ltd., Shenzhen, Guangdong (CN)

(72) Inventors: Kaiyang Yuan, Shanghai (CN); Xuemei Yuan, Shanghai (CN); Chengwen Wang, Shenzhen (CN); Jian Gong, Shenzhen (CN); Xiaohui Shen, Kista (SE)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 14/807,629

(22) Filed: Jul. 23, 2015

(65) Prior Publication Data

US 2015/0333446 A1 Nov. 19, 2015

Related U.S. Application Data

(63) Continuation of application No. PCT/CN2013/070878, filed on Jan. 23, 2013.

(51) Int. Cl.
*H01R 13/64* (2006.01)
*H01R 13/631* (2006.01)
*H01R 13/66* (2006.01)

(52) U.S. Cl.
CPC ..... *H01R 13/6315* (2013.01); *H01R 13/665* (2013.01)

(58) Field of Classification Search
CPC ..... H01R 13/28; H01R 13/6315
USPC ..... 439/248
See application file for complete search history.

(56) References Cited

U.S. PATENT DOCUMENTS

| | | | | |
|---|---|---|---|---|
| 6,027,360 | A | 2/2000 | Jenkins | |
| 6,592,387 | B2 | 7/2003 | Komenda et al. | |
| 2002/0081881 | A1 | 6/2002 | Komenda et al. | |
| 2006/0141836 | A1* | 6/2006 | Van Der Mee .... | H01R 13/6315 439/247 |
| 2009/0068870 | A1* | 3/2009 | Mezhinsky ..... | G02B 6/3882 439/247 |

FOREIGN PATENT DOCUMENTS

| | | | |
|---|---|---|---|
| CN | 201112913 | Y | 9/2008 |
| CN | 102377071 | A | 3/2012 |
| CN | 202405528 | U | 8/2012 |
| CN | 202678631 | U * | 1/2013 |

(Continued)

*Primary Examiner* — Abdullah Riyami
*Assistant Examiner* — Nader Alhawamdeh

(57) ABSTRACT

The present invention provides a blind-mate integrated connector, including: a first installation plate, a mechanical part, and a second installation plate; a first guiding structure and first connection ends of at least two sub-connectors are installed in the mechanical part; the first installation plate is connected to the mechanical part; the second installation plate is disposed with second connection ends matching the first connection ends of the sub-connectors in the mechanical part, and the second installation plate is further disposed with a second guiding structure matching the first guiding structures. By practicing the present invention, multiple sub-connectors may be flexibly integrated without a need to design a dedicated connector mold, thereby achieving cost savings and shortening a development cycle.

10 Claims, 5 Drawing Sheets

(56) References Cited

FOREIGN PATENT DOCUMENTS

| | | | |
|---|---|---|---|
| EP | 1 107 390 | A2 | 6/2001 |
| EP | 1 670 301 | A1 | 6/2006 |
| FR | 2947674 | A1 | 1/2011 |

* cited by examiner

BLIND-MATE INTEGRATED CONNECTOR

CROSS-REFERENCE TO RELATED APPLICATIONS

This application is a continuation of International Application No. PCT/CN2013/070878, filed on Jan. 23, 2013, which is hereby incorporated by reference in its entirety.

TECHNICAL FIELD

The present invention relates to mechanical technologies, and in particular, to a blind-mate integrated connector.

BACKGROUND

In a wireless communications field, development of network devices is directed towards integration of functional units, and integrated network devices can process multiple types of signals, such as high-speed signals, low-speed control signals, radio frequency signals, and power supply signals. A blind-mate assembly mode is typically used between functional modules of the integrated network devices to facilitate configuration flexibility and ease in field maintenance. In an existing mixed blind-mate connector, different types of connectors are injection molded in an integrated manner by using a set of dedicated connector molds. The mixed blind-mate connector provides a certain level of guiding capability, for example, to install a high-speed backplane connector, a power supply connector, and a power supply signal connector together by using a blind-mate connector.

In an existing mixed blind-mate solution, different types of connectors are injection molded in an integrated manner by means of a dedicated connector mold. FIG. 1 is a broken away perspective view of a mixed blind-mate connector according to the prior art. As shown in FIG. 1, a signal connection part (a female end) and a power supply connection part (a female end) are injection molded in an integrated manner to be a female end of the mixed connector, whereas a signal connection part (a male end) and a power supply connection part (a male end) are injection molded in an integrated manner to be a male end of the mixed connector. The male end and the female end of the mixed connector match each other, which is implemented by using a guide pin located at both ends of a plastic body.

A mold needs to be developed in advance for the existing mixed blind-mate connector. The mold is usually complex, costly, and with a long development cycle. In addition to above, multiple connectors cannot be flexibly combined or paired by using the mold.

SUMMARY

The present invention provides a blind-mate integrated connector that is configured to flexibly integrate multiple connectors, and further configured to increase an overall radial tolerance capability and axial tolerance capability of the blind-mate connector after integration.

The present invention provides a blind-mate integrated connector, including: a first installation plate, a mechanical part, and a second installation plate, where a first guiding structure and first connection ends of at least two sub-connectors are installed in the mechanical part;

the first installation plate is connected to the mechanical part; and second connection ends matching the first connection ends of the sub-connectors in the mechanical part are installed on the second installation plate, and the second installation plate is further disposed with a second guiding structure matching the first guiding structure.

With reference to the foregoing technical solution, in a first possible implementation, the mechanical part is further disposed with a printed circuit board, a first connection end of each of the sub-connectors is disposed on the printed circuit board, and a signal line at a first connection end of each of the sub-connectors is routed out by using a cable on the printed circuit board.

With reference to the foregoing technical solution or the first possible implementation of the foregoing technical solution, in a second possible implementation, the mechanical part is embedded in a hollow part of the first installation plate, locking protrusions protrude out of a housing of the mechanical part, and the mechanical part is connected to the first installation plate by using the locking protrusions; the mechanical part is further disposed with a groove, and a signal line at a first connection end of each of the sub-connectors is routed out and fastened by using the groove.

With reference to the foregoing technical solution or the first and the second possible implementations of the foregoing technical solution, in a third possible implementation, the connector further includes a floating mechanism, and the first installation plate is connected to the mechanical part by using the floating mechanism;

the floating mechanism includes connection posts, where the connection posts are connected to the mechanical part by passing through round holes in the first installation plate, or the connection posts are connected to the first installation plate by passing through round holes in the mechanical part, and each of the round holes has a greater diameter than each of the connection posts.

With reference to the foregoing technical solution or the first to the third possible implementations of the foregoing technical solutions, in a fourth possible implementation, the floating mechanism further includes springs disposed on the connection posts, and the connection posts are located between the mechanical part and the first installation plate.

In the blind-mate integrated connector provided by the present invention, different connection ends of at least two sub-connectors can be flexibly installed in the mechanical part and on the second installation plate. Therefore, multiple sub-connectors may be integrated by using the blind-mate integrated connector provided by the present invention, with no need to develop a connector mold. Further, by using the floating mechanism, the first installation plate is connected to the mechanical part inside which first connection ends of sub-connectors are disposed. Radial tolerance of the blind-mate integrated connector is classified into radial tolerance in an assembly process and radial tolerance after integration, and therefore overall radial tolerance of the blind-mate integrated connector is increased. Still further, the floating mechanism further includes springs disposed between the mechanical part and the first installation plate, and rebound force of the springs enables the entire blind-mate integrated connector after integration to possess an axial tolerance capability, thereby increasing overall axial tolerance of the blind-mate integrated connector. Therefore, the blind-mate integrated connector provided by the present invention can be applied to a scenario of high tolerance requirements at low costs within a short development cycle.

DETAILED DESCRIPTION

Figure 1:
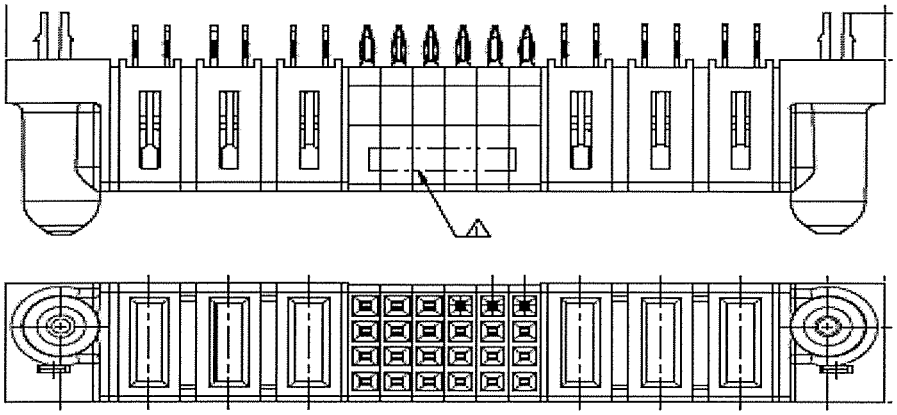
FIG. 1 is a broken away perspective view of a mixed blind-mate connector according to the prior art.

A blind-mate integrated connector provided by the present invention includes: a first installation plate, a mechanical part, and a second installation plate. The blind-mate integrated connector may be fastened to a to-be-assembled peripheral device of a product by using the first installation plate or the second installation plate.

The first installation plate is connected to the mechanical part. In the mechanical part, a first guiding structure and first connection ends of at least two sub-connectors are installed. On the second installation plate, second connection ends matching the first connection ends of the sub-connectors in the mechanical part are installed. The sub-connector may be a signal connector, a power supply connector, a radio-frequency coaxial connector, or the like. The first connection end of the sub-connector may be a male end of the sub-connector, and correspondingly, the second connection end of the sub-connector is a female end of the sub-connector. Alternatively, the first connection end of the sub-connector may be a male end of the sub-connector, and correspondingly, the second connection end of the sub-connector is a female end of the sub-connector. For example, a female end of a signal connector, a female end of a power supply connector, and a female end of a radio-frequency coaxial connector are installed in the mechanical part; correspondingly, a male end of the signal connector, a male end of the power supply connector, and a male end of the radio-frequency coaxial connector are installed on the second installation plate. For another example, a male end of a signal connector, a male end of a power supply connector, and a male end of the radio-frequency coaxial connector are installed in the mechanical part; correspondingly, a female end of the signal connector, a female end of the power supply connector, and a female end of the radio-frequency coaxial connector are installed on the second installation plate. For still another example, a female end of a signal connector, a female end of a power supply connector, and a male end of a radio-frequency coaxial connector are installed in the mechanical part; correspondingly, a male end of the signal connector, a male end of the power supply connector, and a female end of the radio-frequency coaxial connector are installed on the second installation plate.

The second installation plate is further disposed with a second guiding structure matching the first guiding structure. The first guiding structure and the second guiding structure may be a guide bushing and a guide pin, respectively.

Assembly of the blind-mate integrated connector provided by embodiments of the present invention begins with matching of the second guiding structure on the second installation plate with the first guiding structure in the mechanical part. In a process of assembling the first guiding structure and the second guiding structure, the second connection end of each sub-connector on the second installation plate matches the corresponding first connection end inside the mechanical part, thereby connecting the sub-connectors to the foregoing device. For example, a female end of the sub-connector is installed in the mechanical part, and a male end of the sub-connector is installed on the second installation part, and in a process of assembling the first guiding structure and the second guiding structure, the female end and the male end of the sub-connector match each other.

Optionally, the mechanical part may be disposed with a printed circuit board (Printed Circuit Board, PCB for short), and the first connection end of each sub-connector may be welded or crimped on the printed circuit board. A signal line at the first connection end of each sub-connector is routed out through the printed circuit board and connected to the to-be-assembled peripheral device.

Optionally, the mechanical part is embedded in a hollow part of the first installation plate, locking protrusions protrude out of a housing of the mechanical part, and the mechanical part is connected to the first installation plate by using the locking protrusions. The mechanical part is further disposed with a groove, for example, a U-shaped groove. A signal line at the first connection end of each sub-connector is routed out and fastened by using the groove.

In the blind-mate integrated connector provided by the present invention, first connection ends of at least two sub-connectors are installed in the mechanical part, and second connection ends matching the first connection ends of the sub-connectors in the mechanical part are installed on the second installation plate. In a process of assembling the first guiding structure on the first installation plate and the second guiding structure on the second installation plate, the second connection end of each sub-connector on the second installation plate may match the second connection end of each sub-connector located inside the mechanical part. The mechanical part is connected to the first installation plate; the first installation plate or the second installation plate is fastened to the product of the to-be-assembled peripheral device; and the second connection end of each sub-connector on the second installation plate matches the corresponding first connection end in the mechanical part, thereby implementing connection of each sub-connector to the foregoing device. In the blind-mate integrated connector provided by the present invention, different connection ends of at least two sub-connectors can be flexibly installed in the mechanical part and on the second installation plate, with no need to develop a connector mold. Therefore, the blind-mate integrated connector provided by the present invention can flexibly integrate multiple sub-connectors.

Further, based on the flexible integration of multiple sub-connectors, a radial tolerance capability of the blind-mate integrated connector is enhanced by using a floating mechanism to connect the foregoing first installation plate and the mechanical part. The floating mechanism includes connection posts, where the connection posts are connected to the mechanical part by passing through round holes in the first installation plate, or the connection posts are connected to the first installation plate by passing through round holes in the mechanical part, where each of the round holes has a greater diameter than each of the connection posts. The connection post may be a cap bolt that includes a bolt cap and a shank, or may be a screw, or may be a positioning pin.

A first solution for connecting the connection posts to the first installation plate and the mechanical part is as follows:

The first installation plate is disposed with round holes, each of which has a greater diameter than each of the connection posts, and the connection posts are connected to the mechanical part by passing through the round holes in the first installation plate. A second solution for connecting the connection posts to the first installation plate and the mechanical part is as follows: The mechanical part is disposed with round holes, each of which has a greater diameter than each of the connection posts, and the connection posts are connected to the first installation plate by passing through the round holes in the mechanical part.

Therefore, the foregoing floating mechanism works such that the connection posts are connected to the mechanical part bypassing the connection posts through the round holes in the first installation plate, where each of the round holes has a greater diameter than each of the connection posts. Alternatively, the foregoing floating mechanism works such that the connection posts are connected to the first installation plate by passing the connection posts through the round holes in the mechanical part, where each of the round holes has a greater diameter than each of the connection posts. The connection posts may be connected to the mechanical part by using screw threads, or may be connected in other manners. Similarly, the connection posts may be connected to the first installation plate by using screw threads, or may be connected in other manners.

In the foregoing floating mechanism, because each of the round holes that the connection posts pass through has a greater diameter than each of the connection posts, if the first installation plate is fastened, the mechanical part may move relative to the first installation plate in a radial manner; correspondingly, if the mechanical part is fastened, the first installation plate may move relative to the mechanical part. Therefore, in a process of matching the second guiding structure on the second installation plate with the first guiding structure in the mechanical part, the second connection end of each sub-connector on the second installation plate and the corresponding first connection end located inside the mechanical part are driven to move in a radial manner as a whole, so that a radial movement range increases when the first connection end and the second connection end of each sub-connector match. It is ensured that when matching is performed for each sub-connector, a radial location deviation falls within a radial tolerance capability of each sub-connector. In this way, a radial tolerance capability of the blind-mate integrated connector in an assembly process is improved, and ultimately an overall radial tolerance capability of the blind-mate integrated connector after integration is improved. A greater matching gap between the connection posts and the first installation plate or the mechanical part after the connection post passes through the round holes leads to a greater radial location deviation and a greater radial tolerance capability of the blind-mate integrated connector. As explained above, the blind-mate integrated connector according to the present invention provides two levels of radial tolerance: one is an overall radial tolerance capability of the blind-mate integrated connector in an assembly process, and the other is radial tolerance of each sub-connector after assembly. Compared with the blind-mate integrated connector in the present invention, an existing blind-mate connector in the prior art exhibits a lower radial tolerance capability in an assembly process, because the radial tolerance capability thereof depends only on a tolerance capability of each sub-connector in the blind-mate connector.

Further, after the overall radial tolerance capability of the blind-mate integrated connector is improved, to increase an overall axial tolerance capability of the blind-mate integrated connector, the floating mechanism further includes springs. The springs are located between the mechanical part and the first installation plate and are disposed on the connection posts. In other words, the springs are disposed on the connection posts such that one end of each spring is connected to the first installation plate and the other end is connected to the mechanical part. The connection posts are connected to the mechanical part by passing through the round holes in the first installation plate and then the springs; alternatively, the connection posts are connected to the first installation plate by passing through the round holes in the mechanical part and then the springs.

The springs are disposed between the mechanical part and the first installation plate, and the first installation plate and the mechanical part is connected in a movable manner. After the second guiding structure on the second installation plate match the first guiding structure in the mechanical part, the springs are compressed by the mechanical part and the first installation plate, and rebound force produced by the springs provides axial tolerance for the second connection end of each sub-connector on the second installation plate and the corresponding first connection end located inside the mechanical part. An axial tolerance capability of the existing blind-mate connector in the prior art depends only on an axial tolerance capability of each sub-connector in the blind-mate connector. However, axial tolerance of the blind-mate integrated connector provided by the present invention includes overall axial tolerance provided by the blind-mate integrated connector and axial tolerance provided by each sub-connector in a floating connector.

Still further, to prevent the springs disposed on the connection posts from escaping from the round holes due to excessively large round holes in the mechanical part, the floating mechanism further includes spacing rings, where the spacing rings are disposed on the connection posts. In the first solution for connecting the connection posts to the first installation plate and the mechanical part, the connection posts are connected to the mechanical part by successively passing through the round holes disposed on the first installation plate, the spacing rings, and the springs, where the spacing rings are located between the round holes in the first installation plate and the springs to prevent the springs disposed on the connection posts from escaping from the round holes due to excessively large round holes in the first installation plate. In the second solution for connecting the connection posts to the first installation plate and the mechanical part, the connection posts are connected to the first installation plate by successively passing through the round holes disposed in the mechanical part, the spacing rings, and the springs, where the spacing rings are located between the round holes in the mechanical part and the springs to prevent the springs disposed on the connection posts from escaping from the round holes due to the excessively large round holes in the mechanical part.

In the blind-mate integrated connector provided by the present invention, a first installation plate is connected to a first installation plate by using a floating mechanism that includes connection posts. The connection posts are connected to the mechanical part by passing through round holes in the first installation plate, or the connection posts are connected to the first installation plate by passing through round holes in the mechanical part. Each of the round holes that the connection posts pass through has a greater diameter than each of the connection posts. Therefore, a radial movement range increases when a first connection end and a second connection end of each sub-connector match. Further, it is ensured that a radial location deviation falls within a radial tolerance capability of each sub-connector when matching is performed for each sub-connector, and ultimately a radial tolerance capability of the blind-mate integrated connector in the assembly process is improved. Further, the floating mechanism further includes springs disposed between the mechanical part and the first installation plate, and rebound force of the springs enables the entire blind-mate integrated connector after integration to possess an axial tolerance capability, thereby increasing overall axial tolerance of the blind-mate integrated connector. Therefore, the blind-mate integrated connector provided by the present invention can be applied to a scenario in which a large tolerance is required. In addition, different connection ends of at least two sub-connectors can be flexibly installed in the mechanical part and on a second installation plate. The blind-mate integrated connector provided by the present invention can flexibly integrate multiple sub-connectors, with no need to develop a connector mold, thereby achieving cost savings and shortening a development cycle.

Figure 2:
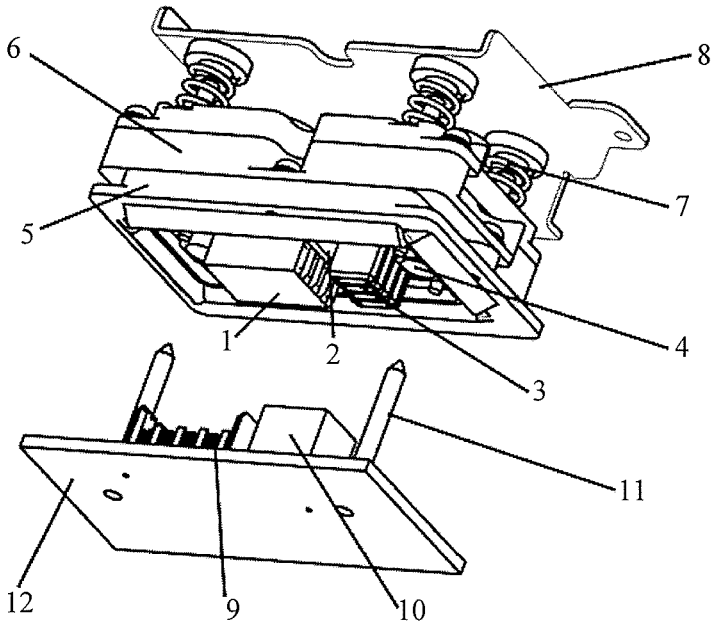
FIG. 2 is a 3D diagram of a blind-mate integrated connector according to an embodiment of the present invention.
Figure 3A:
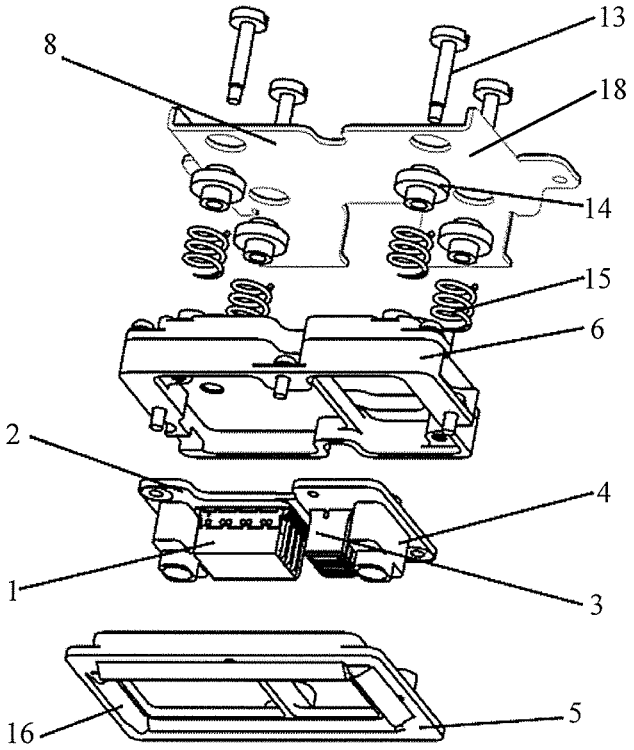
FIG. 3A is a schematic exploded view of the blind-mate integrated connector shown in FIG. 2.
Figure 3B:
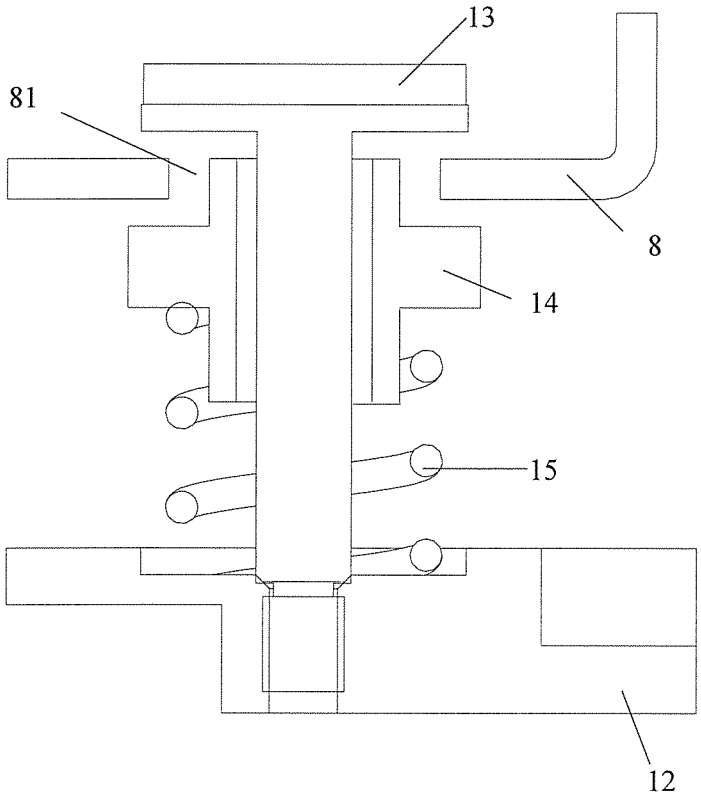
FIG. 3B is a broken away perspective view of a floating mechanism shown in FIG. 2.

FIG. 2 is a 3D diagram of a blind-mate integrated connector according to an embodiment of the present invention. FIG. 3A is a schematic exploded view of the blind-mate integrated connector shown in FIG. 2. FIG. 3B is a broken away perspective view of a floating mechanism in FIG. 2. As shown in FIG. 2, the blind-mate integrated connector includes a first installation plate 8, a mechanical part, and a second installation plate 12. The mechanical part includes an upper mechanical part 6 and a lower mechanical part 5. The blind-mate integrated connector is fastened to a to-be-assembled peripheral device of a product by using the first installation plate 8.

In the mechanical part, a female end of a sub-connector 1 and a female end of a sub-connector 3 is installed on a PCB 2, where the sub-connector 1 and the sub-connector 3 are of different types. The PCB 2 is clipped and fastened by using the upper mechanical part 6 and the lower mechanical part 5. A signal of the sub-connector 1 and a signal of the sub-connector 3 are routed out by using a cable welded on the PCB 2.

First guiding structures 4 are further installed on the PCB 2. In addition, the first guiding structures 4 may be directly disposed on the mechanical part, that is to say, the first guiding structures 4 and the mechanical part are designed as an integrated whole.

A male end 9 of the sub-connector 1 and a male end 10 of the sub-connector 3 are installed on the second installation plate 12, and second guiding structures 11 matching the first guiding structures 4 are further installed on the second installation plate 12. The first guiding structures 4 may be guide bushings, and the second guiding structures 11 may be guide pins. In an assembly process, the first guiding structures 4 match the second guiding structures 11 before the sub-connectors are matched, and a tolerance is absorbed by using a floating mechanism, so as to ensure that a location deviation falls within a tolerance range of each sub-connector when a male end and a female end of each integrated sub-connector are assembled.

In addition, as an alternative, a male end of the sub-connector 1 and a male end of the sub-connector 3 may be installed on one PCB 2, and the female end of the sub-connector 1 and the female end of the sub-connector 3 are installed on the second installation plate 12.

As shown in FIG. 3A, the floating mechanism includes screws 13, round holes 81 in the first installation plate 8, spacing rings 14, and springs 15. The round holes are disposed in the first installation plate 8; and the spacing rings 14 and the springs 15 are disposed between the first installation plate 8 and the mechanical part. The screws 13 are connected to the upper mechanical part 6 by successively passing through the round holes in the first installation plate 8, the spacing rings 14 and the springs 15. The spacing rings 14 can prevent the springs 15 from escaping out of the round holes in the first installation plate. As shown in FIG. 3B, each of the round holes 81 in the first installation plate 8 has a greater diameter than each of the screws, and a central-hole diameter of each spacing ring 14 is less than a diameter of each spring. The screws 13 may be connected to the upper mechanical part 6 by using screw threads, or may be connected in other manners.

In the floating mechanism shown in FIG. 3A, because each of the round holes that the screws 13 pass through has a greater diameter than each of the screws 13, if the first installation plate 8 is fastened, the mechanical part may move relative to the first installation plate 8 in a radial manner, and correspondingly, if the mechanical part is fastened, the first installation plate 8 may move relative to the mechanical part. Therefore, in a process of matching the second guiding structures 11 on the second installation plate 12 with the first guiding structures 4 in the mechanical part, a male end of each sub-connector on the second installation plate 12 and a corresponding female end located inside the mechanical part may move in a radial manner as a whole, thereby increasing a radial tolerance capability of the blind-mate integrated connector in an assembly process. After the second guiding structures 11 on the second installation plate 12 match the first guiding structures 4 in the mechanical part, the springs 15 are compressed by the first installation plate 8 and the mechanical part, and rebound force of the springs may provide axial tolerance for the male end of each sub-connector on the second installation plate and the corresponding female end located inside the mechanical part.

Further, after the blind-mate integrated connector is assembled, a metal spring plate 16 in the mechanical part is attached to a metallic lustrous copper area on the second installation plate 12. After the metal spring plate 16 is attached to the metallic lustrous copper area on the second installation plate 12, the metal spring plate 16 and a housing of the mechanical part jointly provide electromagnetic shielding for the connector.

In this embodiment, the floating mechanism connecting the first installation plate and the mechanical part includes the screws 13, the round holes in the first installation plate 8, the spacing rings 14, and the springs 15. The first installation plate 8 is fastened to the product of the to-be-assembled peripheral device. Because each of the round holes that the screw 13 pass through has a greater diameter than each of the screws 13, the mechanical part may move relative to the first installation plate 8 in a radial manner. In the process of matching the second guiding structures on the second installation plate with the first guiding structures in the mechanical part, the male end of each sub-connector on the second installation plate and the corresponding female end located inside the mechanical part may be empowered to move in a radial manner as a whole, so that the blind-mate integrated connector possesses a radial tolerance capability in the assembly process. In addition, after the second guiding structures 11 on the second installation plate 12 match the first guiding structures 4 in the mechanical part, the springs are compressed, and elastic force of the springs may provide axial tolerance for the male end of each sub-connector on the second installation plate and the corresponding female end located inside the mechanical part.

In the embodiment provided by FIG. 2, there is further an equivalent alternative solution, where the upper mechanical part 6 is disposed with round holes, and the screws 13 are connected to the first installation plate by successively passing through the round holes in the upper mechanical part 6, spacing rings, and springs. Both a diameter of each round hole in the upper mechanical part 6 and the central-hole diameter of each spacing ring 14 are greater than the diameter of each screw. Similarly, the screws 13 may be connected to the first installation plate 8 by using screw threads, or may be connected in other manners.

In the embodiment provided by FIG. 2, the mechanical part and the first installation plate are paralleled to each other. There is further an alternative solution for arranging a location relationship between the mechanical part and the first installation plate, where the first installation plate is a hollow installation plate, the mechanical part is embedded into a hollow part of the first installation plate with a gap available between the housing of the mechanical part and the hollow part of the mechanical part, and locking protrusions protrude out of the housing of the mechanical part. The screws are connected to the locking protrusions by passing through the round holes in the first installation plate, and alternatively, the screws may be connected to the first installation plate by passing through round holes in the locking protrusions. In this solution, the PCB 2 may not be present in the mechanical part, the female end of each sub-connector is installed inside the mechanical part, and a cable welded in a rear part of each sub-connector is routed out and fastened by using a U-shaped groove disposed inside the mechanical part.

Figure 4:
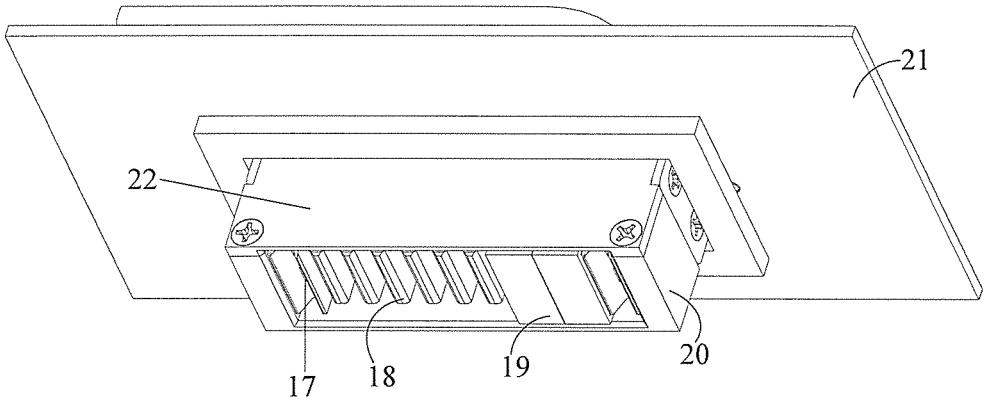
FIG. 4 is a schematic 3D diagram of another blind-mate integrated connector according to an embodiment of the present invention.
Figure 5:
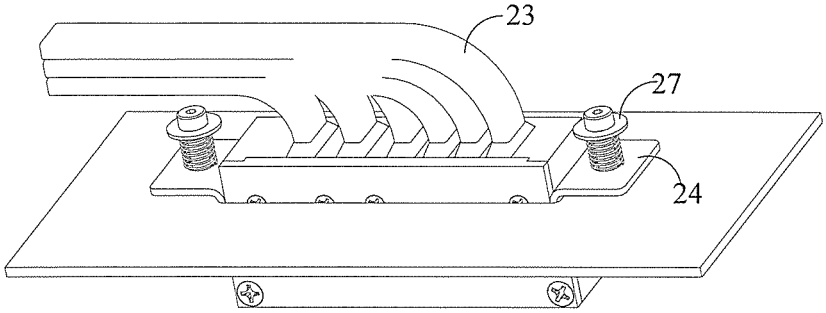
FIG. 5 is another schematic 3D diagram of the blind-mate integrated connector shown in FIG. 4.
Figure 6:
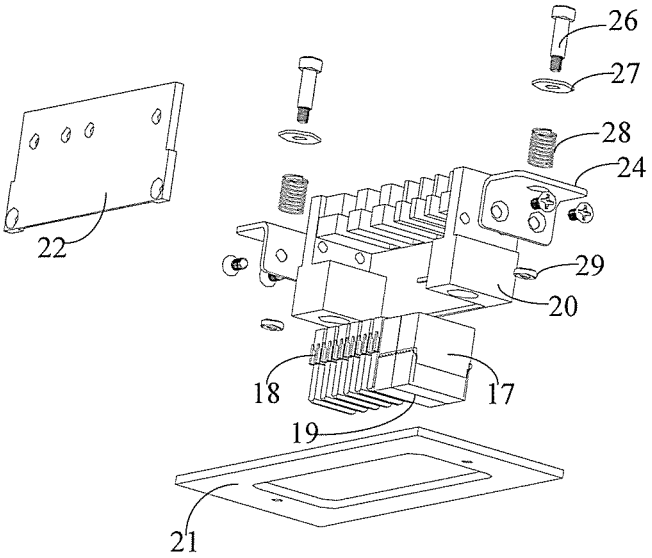
FIG. 6 is a schematic exploded view of FIG. 4.

FIG. 4 is a schematic 3D diagram of another blind-mate integrated connector according to an embodiment of the present invention. FIG. 5 is a schematic 3D diagram of FIG. 4. FIG. 6 is a broken away perspective view of FIG. 4. With reference to FIG. 4, FIG. 5, and FIG. 6, a first installation plate 21 is a hollow installation plate, a mechanical part includes a side panel 20 and a front panel 22, where the side panel 20 and the front panel 22 are connected and assembled by using screws.

As shown in FIG. 6, what is different from FIG. 2 is that the mechanical part may not be disposed with a PCB on which a sub-connector 18 and a sub-connector 19 are installed. A female end of the sub-connector 18 and a female end of the sub-connector 19 are installed in a U-shaped groove disposed inside the mechanical part. Both a rear part of the female end of the sub-connector 18 and a rear part of the female end of the sub-connector 19 are welded with cables, and a signal of the sub-connector 18 and a signal of the sub-connector 19 are output by using the cables. A first guiding structure 17 is further installed on the mechanical part. Cables in the rear part of the female end of the sub-connector 18 and in the rear part of the female end of the sub-connector 19 are routed out and fastened by using the groove.

A male end of the sub-connector 18, a male end of the sub-connector 19, and a second guiding structure matching the first guiding structure 17 are installed on the second installation plate, where the second installation plate is not shown in FIG. 4, FIG. 5, and FIG. 6.

As shown in FIG. 5 and FIG. 6, the mechanical part is embedded into a hollow part of the first installation plate 21, and there is a gap between a housing of the mechanical part and the hollow part of the mechanical part. Locking protrusions 24 protrude out of the housing of the mechanical part, to be specific, they protrude out of the side panel 20. Different from FIG. 2, positioning pins 26 are connected to the first installation plate 21 by successively passing through upper spacing rings 27, springs 28, and round holes in the locking protrusions 24. Further, after passing through the round holes in the locking protrusions 24, the positioning pins 26 may further pass through lower spacing rings 29, and then are connected to the first installation plate 21. Each of the upper spacing rings has a greater diameter than each of the positioning pins 26. In this embodiment, a floating mechanism includes the positioning pins 26, the upper spacing rings 27, the springs 28, and the locking protrusions 24.

Each of the upper spacing rings 27 has a greater diameter than each of the positioning pins 26, and a gap is present between the housing of the mechanical part and the hollow part of the mechanical part. For these two reasons, the mechanical part may move in a radial manner in the hollow part of the first installation plate. Therefore, in a process of matching the second guiding structure on the second installation plate with the first guiding structure 17 in the mechanical part, the male end of each sub-connector on the second installation plate and a corresponding female end located inside the mechanical part may move in a radial manner as a whole, thereby increasing a radial tolerance capability of the blind-mate integrated connector in an assembly process.

In addition to above, because the springs are disposed between the upper spacing rings 27 and the locking protrusions 24, after the guiding structure on the second installation plate matches the first guiding structure 17 inside the mechanical part, the springs 28 are compressed by the upper spacing rings 27 and the locking protrusions 24, and elastic force of the spring may provide axial tolerance for the male end of each sub-connector on the second installation plate and the corresponding female end located inside the mechanical part.

A function of the upper spacing rings 27 is to compress the springs 28 by working with the locking protrusions 24. The springs may be disposed between the locking protrusions 24 and the first installation plate 21, and the springs are compressed by the locking protrusions 24 and the first installation plate 21, and therefore the upper spacing rings 27 do not need to be disposed. The positioning pins 26 may pass through the round holes in the locking protrusions 24, then pass through the springs 28, and finally are connected to the first installation plate 21. Alternatively, the positioning pins 26 may successively pass through round holes in the first installation plate 21 and the springs 28, and then are connected to the locking protrusions 24.

The blind-mate integrated connector provided by this embodiment increases a tolerance capability, and can flexibly integrate multiple sub-connectors, with no need to design a dedicated connector mold, thereby achieving cost savings and shortening a development cycle.

Figure 7:
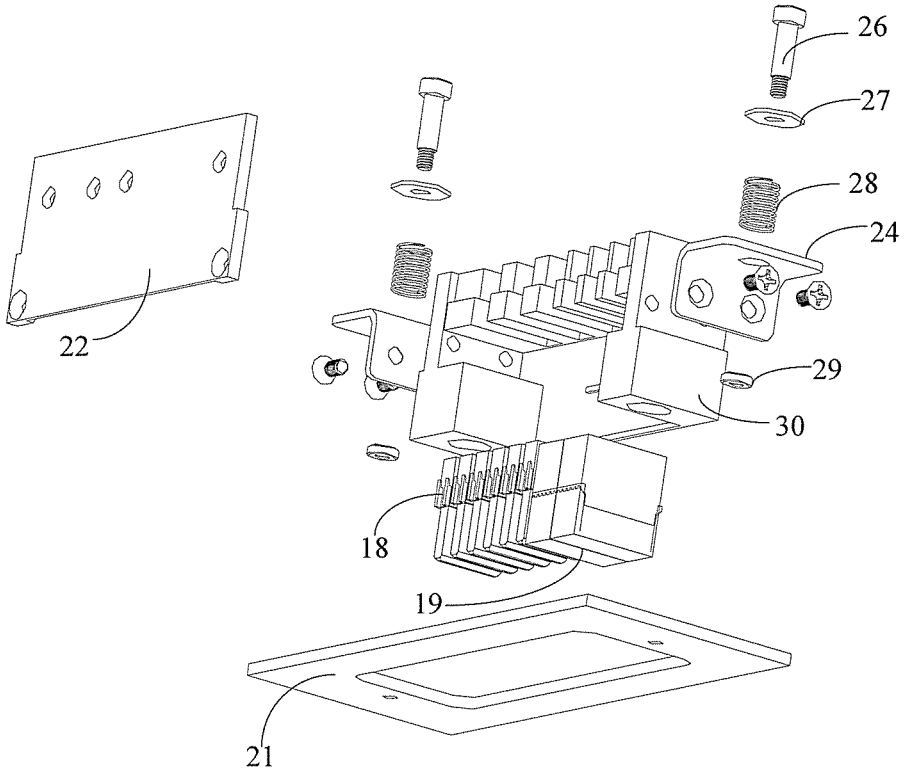
FIG. 7 is a schematic exploded view of still another blind-mate integrated connector according to an embodiment of the present invention.

FIG. 7 is a broken away perspective view of still another blind-mate integrated connector according to an embodiment of the present invention. A difference between FIG. 7 and FIG. 6 lies in that guiding structure 30 used for assembling the blind-mate integrated connector is disposed together with the mechanical part as an integrated whole. However, in FIG. 6, the first guiding structure 17 and the mechanical part are separately disposed, and are installed inside the mechanical part along with the female end of the sub-connector 18 and the female end of the sub-connector 19.

Finally, it should be noted that the foregoing embodiments are merely intended for describing the technical solutions of the present invention, but not for limiting the present invention. Although the present invention is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present invention. Finally, it should be noted that the foregoing embodiments are merely intended for describing the technical solutions of the present invention, but not for limiting the present invention. Although the present invention is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present invention.

What is claimed is:

1. A blind-mate integrated connector, comprising:

a mechanical part having a first guiding structure and first connection ends of at least two sub-connectors;

a first installation plate connected to the mechanical part; and a second installation plate having second connection ends matching the first connection ends of the at least two sub-connectors in the mechanical part and a second guiding structure matching the first guiding structure;

wherein the mechanical part is embedded into a hollow part of the first installation plate, and locking protrusions protrude out of a housing of the mechanical part; and the mechanical part is connected to the first installation plate by using the locking protrusions.

2. The connector according to claim 1, wherein:

the mechanical part further comprises a printed circuit board;

a first connection end of each of the at least two sub-connectors is disposed on the printed circuit board; and a signal line at a first connection end of each of the at least two sub-connectors is routed out using a cable on the printed circuit board.

3. The connector according to claim 1, wherein:

the mechanical part is further disposed with a groove, and a signal line at a first connection end of each of the at least two sub-connectors is routed out and fastened by using the groove.

4. The connector according to claim 1, wherein:

the connector further comprises a floating mechanism;

the first installation plate is connected to the mechanical part by using the floating mechanism; and the floating mechanism comprises:

connection posts connected to the mechanical part by passing through round holes in the first installation plate, or connection posts connected to the first installation plate by passing through round holes in the mechanical part, wherein each of the round holes has a greater diameter than each of the connection posts.

5. The connector according to claim 4, wherein the floating mechanism further comprises springs disposed on the connection posts, and the connection posts are located between the mechanical part and the first installation plate.

6. The connector according to claim 5, wherein the floating mechanism further comprises spacing rings disposed on the connection posts, and the spacing rings are located between the round holes in the first installation plate and the springs or between the round holes in the mechanical part and the springs.

7. The connector according to claim 1, wherein:

the connector further comprises a floating mechanism;

the first installation plate is connected to the locking protrusions by using the floating mechanism;

the floating mechanism comprises:

connection posts connected to the locking protrusions by passing through round holes in the first installation plate, or connection posts connected to the first installation plate by passing through round holes in the locking protrusions; and there is a gap between the housing of the mechanical part and the hollow part of the mechanical part, and each of the round holes has a greater diameter than each of the connection posts.

8. The connector according to claim 7, wherein the floating mechanism further comprises springs disposed on the connection posts, and the connection posts are located between the locking protrusions and the first installation plate.

9. The connector according to claim 7, wherein:

the floating mechanism further comprises upper spacing rings disposed on the connection posts and the springs disposed on the connection posts;

a central-hole diameter of each upper spacing ring is greater than a diameter of each connection post; and the connection posts are connected to the first installation plate by successively passing through the upper spacing rings, the springs, and the round holes in the locking protrusions.

10. The connector according to claim 1, wherein:

the mechanical part is further disposed with a metal spring plate attached to a metallic lustrous copper area of the second installation plate; and the metal spring plate, the metallic lustrous copper area of the second installation plate, and the housing of the mechanical part jointly provide electromagnetic shielding for the connector.

* * * * *